US008732964B2

(12) United States Patent
Fischer et al.

(10) Patent No.: US 8,732,964 B2
(45) Date of Patent: May 27, 2014

(54) HAIR REMOVAL DEVICE

(75) Inventors: Uwe Fischer, Darmstadt (DE); Xavier Perez-Lopez, Eschborn (DE); Markus Schuessler, Koenigstein (DE); Andreas Larscheid, Sulzbach (DE)

(73) Assignee: Braun GmbH, Kronberg (DE)

( * ) Notice: Subject to any disclaimer, the term of this patent is extended or adjusted under 35 U.S.C. 154(b) by 854 days.

(21) Appl. No.: 12/679,909

(22) PCT Filed: Sep. 27, 2008

(86) PCT No.: PCT/EP2008/008244

§ 371 (c)(1),
(2), (4) Date: Aug. 16, 2010

(87) PCT Pub. No.: WO2009/052923

PCT Pub. Date: Apr. 30, 2009

(65) Prior Publication Data

US 2010/0299927 A1 Dec. 2, 2010

(30) Foreign Application Priority Data

Oct. 22, 2007 (DE) ..... 10 2007 050 381

(51) Int. Cl.
*B26B 19/26* (2006.01)
*B26B 19/38* (2006.01)

(52) U.S. Cl.
USPC ..... 30/526; 30/34.1

(58) Field of Classification Search
USPC ..... 30/34.05, 34.1, 40.2, 51, 63, 526, 532, 30/537, 541, 535
See application file for complete search history.

(56) References Cited

U.S. PATENT DOCUMENTS

| | | | | |
|---|---|---|---|---|
| 3,111,757 | A * | 11/1963 | Nicholas Dubofsky | 30/537 |
| 3,969,819 | A | 7/1976 | Pepera | |
| 4,322,885 | A | 4/1982 | Osada | |
| 4,393,585 | A | 7/1983 | Nagelkerke | |
| 4,510,687 | A | 4/1985 | Groothuis et al. | |
| 4,558,517 | A | 12/1985 | Gringer | |
| 4,724,614 | A | 2/1988 | Wahl et al. | |
| 4,760,642 | A * | 8/1988 | Kwak | 30/123 |

(Continued)

FOREIGN PATENT DOCUMENTS

| | | |
|---|---|---|
| CA | 2212561 | 2/1998 |
| JP | 50-30994 U | 7/1973 |

(Continued)

OTHER PUBLICATIONS

International Search Report completed Feb. 17, 2009—2 pages.

*Primary Examiner* — Laura M Lee
(74) *Attorney, Agent, or Firm* — Jerry J Yetter; Jason J Camp

(57) ABSTRACT

The invention relates to a hair removal device such as for example an electric shaver or a wet shaver, comprising a main device element (10, 20) which accounts for the major portion of the overall weight, and a separate element (30, 40) which can be coupled therewith and which comprises for example a wet-shave blade cartridge (40). The separate element (30, 40) is connected to the main device element (10, 20) via a coupling (23, 33). Said coupling (23, 33) is designed to open under the effect of forces that exceed a minimum force. When the hair removal device (100) is dropped, the separate element (30, 40) is not damaged despite the comparatively greater weight of the hair removal device.

4 Claims, 4 Drawing Sheets

(56) References Cited

U.S. PATENT DOCUMENTS

| | | | | |
|---|---|---|---|---|
| 4,791,723 | A * | 12/1988 | Jacobson | 30/41 |
| 4,813,138 | A * | 3/1989 | Chen | 30/41 |
| 4,825,546 | A | 5/1989 | Araki et al. | |
| 4,914,816 | A * | 4/1990 | Fenn et al. | 30/45 |
| 5,084,967 | A * | 2/1992 | Nakagawa et al. | 30/34.1 |
| 5,497,553 | A | 3/1996 | Chong | |
| 5,502,896 | A | 4/1996 | Chen | |
| 5,544,415 | A * | 8/1996 | Huang | 30/43.92 |
| 5,855,066 | A * | 1/1999 | Manger | 30/41 |
| 5,911,480 | A * | 6/1999 | Morgan | 30/41 |
| 6,052,905 | A | 4/2000 | Branchinelli et al. | |
| 6,101,721 | A | 8/2000 | Medhurst | |
| 6,192,586 | B1 | 2/2001 | Metcalf et al. | |
| 6,226,869 | B1 | 5/2001 | Heintke et al. | |
| 6,378,210 | B1 * | 4/2002 | Bickford | 30/43.92 |
| 6,584,696 | B2 | 7/2003 | Ferraro | |
| 6,739,054 | B2 | 5/2004 | Oswald | |
| 7,100,286 | B2 | 9/2006 | Nakakura et al. | |
| 7,288,863 | B2 | 10/2007 | Kraus | |
| D568,534 | S | 5/2008 | Micinillo et al. | |
| D571,954 | S | 6/2008 | Kling et al. | |
| 7,434,317 | B2 | 10/2008 | Levine et al. | |
| 7,503,117 | B2 * | 3/2009 | Wetzel et al. | 30/34.1 |
| 7,533,467 | B2 | 5/2009 | Fossella | |
| 7,536,787 | B2 | 5/2009 | Blaustein et al. | |
| 7,611,013 | B2 * | 11/2009 | Leventhal et al. | 206/463 |
| 7,814,661 | B2 * | 10/2010 | Tomassetti | 30/41 |
| 7,937,837 | B2 * | 5/2011 | Psimadas et al. | 30/34.1 |
| 8,307,552 | B1 * | 11/2012 | Drouillard | 30/34.05 |
| 2002/0108252 | A1 | 8/2002 | Ferraro | |
| 2005/0217115 | A1 | 10/2005 | Blaustein et al. | |
| 2007/0006463 | A1 | 1/2007 | Pennella | |
| 2007/0180699 | A1 | 8/2007 | Psimadas et al. | |
| 2008/0016691 | A1 | 1/2008 | Pennella et al. | |
| 2008/0022532 | A1 * | 1/2008 | De Blasis et al. | 30/113.2 |
| 2008/0086887 | A1 | 4/2008 | Park et al. | |
| 2008/0184565 | A1 | 8/2008 | Zoot et al. | |
| 2009/0187523 | A1 | 7/2009 | Salvatore | |
| 2010/0011585 | A1 | 1/2010 | Maichel et al. | |
| 2010/0139097 | A1 | 6/2010 | Perez-Lopez et al. | |
| 2010/0299927 | A1 | 12/2010 | Fischer et al. | |
| 2011/0016723 | A1 | 1/2011 | Maichel et al. | |
| 2011/0126412 | A1 | 6/2011 | Perez-Lopez et al. | |

FOREIGN PATENT DOCUMENTS

| | | | |
|---|---|---|---|
| JP | 54-16690 | U | 7/1977 |
| JP | 55-091670 | U | 6/1980 |
| JP | 56-100089 | A2 | 8/1981 |
| JP | 04-003667 | U | 1/1992 |
| JP | 2003-71155 | A | 3/2003 |
| WO | WO 95-10398 | | 4/1995 |

* cited by examiner

HAIR REMOVAL DEVICE

CROSS-REFERENCE TO RELATED APPLICATIONS

This application claims priority under 35 U.S.C. 120 from International Application PCT/EP08/08244, filed Sep. 27, 2008, which claims priority under 35 U.S.C. 119 to German Application No. 10 2007 050 3816 filed Oct. 22, 2007. The contents of each of these applications are incorporated by reference herein in their entirety.

The invention relates to a hair removal device such as, for example, an electric shaver or a wet shaver or a combination of an electric shaver and a wet shaver.

Such hair removal devices are known to have, for example, blade cartridges for wet shaving and/or a trimmer for long hair, for example, for trimming a beard, head, or body hair. Such separate elements of a hair removal device are typically attached in an exposed manner on the hair removal device and, for this reason, if the device falls to the floor, for example, if the separate element hits the floor, it is subjected to the released forces or drop energy.

Blade cartridges for holding razor blades are known from wet shavers. Damage to such blade cartridges—for example, when the shaver falls to the floor—can release the razor blades and thus create a high risk of injury.

Against this background, it was the object of the present invention to provide a combination of a hair removal device with such a separate element, in particular a blade cartridge that is safe to handle.

The hair removal device can be, in particular, an electric shaver, a wet shaver or a combined shaver made up of both an electric shaver and a wet shaver, wherein the latter device can be driven both manually and electrically (thus, the blade cartridge in a wet shaver can be electrically vibrated). The hair removal device comprises the following components:

a) A "main device element" which makes up the major portion of the total weight of the hair removal device (that is, over 50% of the total weight, preferably over 90% of the total weight). According to the well-known embodiments of hair removal devices, the main device element typically contains an electric motor and/or a rechargeable battery or a battery and, with combined hair removal devices, additionally a shaving foil shaver and/or a trimmer for cutting long hair. In a purely manual wet shaver, the total weight of the main device element can also be affected by a heavy metal handle, etc.

b) A "separate element" which could be damaged if the hair removal device were to fall to the floor with a critical level of drop energy.

The separate element can comprise, in particular, a detachable blade cartridge, containing one or more razor blades for wet shaving. Because, on the one hand, blade cartridges are exposed for shaving, and on the other hand, must be as small as possible (sized for conservation of material), they are very susceptible to breaking when impacted. It is known from empirical experience that increased and regular damage results from weights of 100 g and more and, in particular, of approximately 150 g or more, such as is obtained with rechargeable battery/battery and/or metal handle and/or, additionally, a motor. According to empirical studies, a weight of 150 g, that is, a drop energy of approximately 2.2 J with a fall of 1.5 m, results in consistent damage to the blade cartridge. Obviously, decreased damage could occur even with reduced drop energy, so that a definite limit for the critical drop energy can hardly be specified. The invention can also be utilized with lighter hair removal devices (such as typical wet shavers) to avoid damage that can occur, for example, from dropping the wet shaver from a greater height or from throwing the wet shaver (the user slips and falls and, in doing so, throws the wet shaver to the floor).

The blade cartridge can be attached to the rest of the separate element (to the "intermediate element") by means of a known latching mechanism. In such a case, the separate element comprises an intermediate element and the blade cartridge attached to the intermediate element by means of the latching element.

Further, a coupling is provided to detachably connect the separate element to the main device element, wherein, with respect to at least one given acting direction, a minimum force affecting the separate element, and therefore affecting the coupling, causes the coupling to disengage. The minimum force that causes the coupling to disengage can be set by the structural design of the coupling and can be determined by empirical testing of a given hair removal device, for example, to prevent significant damage to the separate element that would make it unsafe to use. The force necessary to open the coupling is usually applied bluntly on the separate element, i.e., it is applied on the separate element, for example, by a flat or, at most, a slightly curved object. This ensures that if the hair removal device falls to the floor, the coupling can be released (or uncoupled) by means of an acting force (and it is not necessary to activate a hidden mechanism, for example, that is accessible only with a tool). Preferably, the coupling is designed such that it will open when impacted by a force coming from as many directions as possible (in particular, preferably from all possible directions, from which a blunt force can be exerted on an exposed separate element). The coupling consists of a coupling component on the separate element and a coupling component on the main device element, wherein both coupling components form the coupling when the separate element is in the coupled state.

In the described hair removal device, the separate element, which, for example, comprises a blade cartridge, is coupled with a relatively heavy main device element, without the danger of the separate element being substantially damaged making it unsafe for use or being destroyed if the hair removal device is unintentionally dropped. This is achieved with the aid of the detachable coupling, which releases with an effective minimum force, which force is less than the operative force that would result in substantial damage to the separate element making it unsafe to use or even in its destruction. In this way, the separate element is separated by an impact on the main device element such that the kinetic energy of the main device element can no longer be transferred into destructive energy onto the separate element. The kinetic energy is determined, for example, by the weight of the hair removal device and by the height of the fall, if it falls vertically, or according to known formula if it is (accidentally) thrown. The kinetic energy transferred by an impact causes dynamic forces that operate on the separate element, and thus on the coupling, which cannot be easily described. However, empirical drop experiments or FEM studies can be used to determine at what kinetic energy the coupling should open, so that the separate element would not incur substantial damage making it unsafe to use in a vertical fall, for example. In this respect, it can also be said that the coupling is designed so that the separate element will disengage from the main device element in the presence of a given operative force greater than the minimum force, or a given (kinetic) energy greater than the minimum energy.

As noted, the separate element comprises a replaceable blade cartridge. It is particularly important to avoid damage to blade cartridges, so that the blades are not released and then pose a risk of injury. The term "substantial damage making it unsafe to use" is any damage which prevents the blade cartridge from being properly used or which allows it to be used only with a risk of injury.

In contrast to a latching mechanism breaking open with a given force, the described coupling causes a defined, damage-free and reversible disengaging or uncoupling of the separate element from the main device element. The force required for disengaging, that is, the minimum force necessary for uncoupling that must be applied to the coupling, is defined by structural engineering design (and may be different for different operational directions, as long as it is guaranteed that the decoupling occurs when forces are not yet large enough to cause the separate element substantial damage making it unsafe to use).

Further, it has already been pointed out that the main device element can contain, for example, an electric motor, a rechargeable battery, a battery, a shaving foil shaver and/or a trimmer for long hair. These are relatively heavy components, the weight of which can hardly be reduced to below a given minimum, and would result in high kinetic drop energy if the hair removal device were to fall.

According to another embodiment of the hair removal device, the main device element has a base body and an attached moveable slider, wherein the detachable coupling mentioned above is designed between the slider and the separate element. In this way, the separate element takes part in the movement of the slider relative to the main device element. This has the advantage that, in the case of a fall, the separate element moves relative to the main device element, such that, in many cases, damage can be avoided. The slider may be, in particular, an actuating element (switch) for the hair removal device which enables or disables functions of the hair removal device.

According to an embodiment of the above-described embodiment, the hair removal device is designed such that the base body at least partially covers the separate element in (at least) one position of the slider. In these positions, due to the design of the slider, the separate element is then protected by the body against impacts that come from the covered directions.

There are many possibilities for the specific design of the coupling between the main device element and the separate element. According to one embodiment, the coupling is designed as a snap-on connection between the latching elements on the main device element and those on the separate element, i.e., in the engaged state, a positive interlocking of the latching element of the main device element and of the separate element, wherein this state can be entered into and left by overcoming a resistance, and by partial elastic deformation of the latching elements. With appropriate constructive design of the aforementioned resistance (the size of the undercut, etc.), the minimum force and/or minimum energy needed to disconnect the coupling can be adjusted very well.

In a preferred realization of the aforementioned snap-on connection, the latching elements comprise embossments which can reciprocally engage behind one another. The state in which the embossments are engaged behind one another is the coupled state, which can be undone or left when the embossments slide past one another.

Preferably, the coupling between the main device element and the separate element is designed such that it opens with a relative rotation between the main device element and the separate element. In this case, effective torques can be applied harmlessly to the separate element, which causes the separate element to separate from the main device element.

The latching elements can optionally engage one another, at least partially, along a circle around a predetermined axis of rotation. Preferably, the entire engagement area of the latching elements lies on a circle or on concentric circles around the axis of rotation. This has the advantage that the torques acting around the axis of rotation are able to rotate the latching elements relative to each other along their (circular) line of engagement, so that a (limited) rotation of the separate element is possible around the axis of rotation.

In the case described above, the latching elements preferably comprise sliding surfaces inclined at an angle to the axis of rotation which press the latching elements apart axially when the latching elements rotate around the axis of rotation. A rotational motion induced by a torque initiated from the outside around the axis of rotation, by means of the sliding surfaces, can result in an axial movement of separation of the latching elements (axial with respect to the axis of rotation), thus causing the coupling to separate.

In another embodiment, the hair removal device has a spring element that is under load in the coupled state of the separate element, such that a spring force is acting between the main device element and the separate element, which results in the lighter separate element being pushed away from the heavier main device element during the decoupling process due to the expansion of the spring element. Thus, during an impact, the separate element essentially can no longer be positioned between the main device element and the wall or the floor, and damage from this kind of impact can be avoided.

A key element of the above described invention is the detachable coupling between the main device element and the separate element. Because the features of this coupling are found both on the main device element and on the separate element, and these are each separately marketable, the invention further relates to a main device element or a separate element for a hair removal device of the kind described above. In this way, the separate element can be designed, in particular, to be integral with a blade cartridge or to be identical to it.

The invention is described in further detail below with the aid of the accompanying drawings based on an exemplary embodiment of a hair removal device in the form of a combined wet shaver and trimmer for long hair.

FIG. 1 shows, in a perspective view, the hair removal device 100, which is designed here as a combined trimmer and wet shaver, and comprises the following components:

Figure 1:
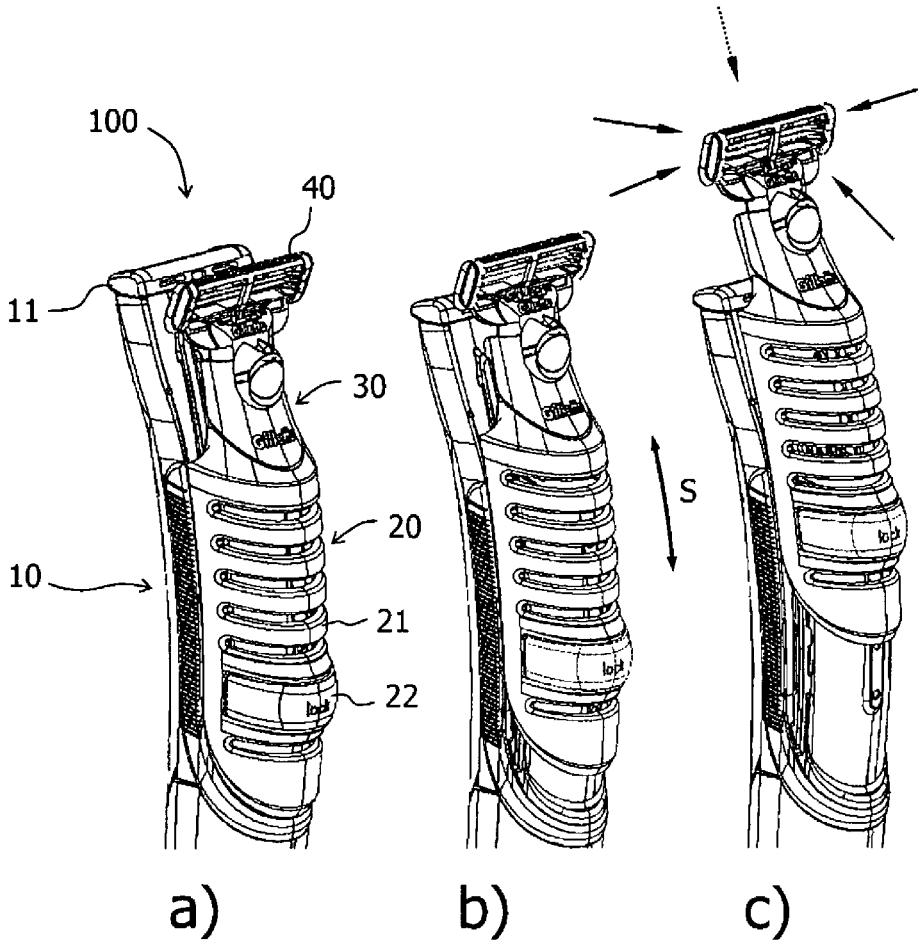
FIG. 1 shows a hair removal device according to the invention a) with the slider control in an idle position
b) with the slider control in a first switching position
c) with the slider control in an additional switching position.

- A base body 10 with a trimmer 11 attached thereto at the top end, wherein the base body 10 further comprises an electric motor and typically also a rechargeable battery or a battery (not shown).
- A slider 20 displaceable in the direction of movement S with a slide base 21 mounted on the base body 10 and a detachable hand-release button 22 which locks into predetermined target positions, thus stopping the slider. The base body 10 and the slider 20 together form the "main device element" of the hair removal device 100.
- A separate element which comprises an intermediate element 30 and a blade cartridge 40 coupled to the intermediate element 30 with a latching mechanism in a known manner, wherein one or more or more parallel blades for a wet shave are fixed or spring-mounted in the blade cartridge 40. The separate element is attached to the slider 20. The blade cartridge 40 is attached here relatively firmly to the intermediate element 30 by a specialized (standardized) latching mechanism. To replace the blade cartridge 40, the user can press a button 32 to release the latching mechanism, which is not described here in detail.

The illustrated hair removal device 100 combines means for an electric shave or an electric haircut with means for wet shaving. One problem in designing such a device is that the separate element, which comprises the blade cartridge 40, must be protected from damage which could result, for example, from a fall from a typical height of about 1.5 meters. Especially critical in this context would be damage that is not actually visible, but that could lead to injury to the user on subsequent use of the blade cartridge 40, for example by protruding blades.

With the combined hair removal device 100, the total weight of which in the illustrated embodiment is approximately 100-150 g, increased to regular damage occurs to the blade cartridge when the hair removal device 100 falls to the floor from a height of about 1.5 m. Such a fall corresponds to a drop energy of about 1.5-2.2 J. For this reason, the following measures for protecting the element from damage from a fall to the floor are described below in more detail.

A first protective mechanism for the separate element, and thus particularly for the blade cartridge 40, is achieved in that the separate element is attached to the slider 20, which can assume a lower target position (FIG. 1*a*), a middle target position (FIG. 1*b*) and an upper target position (FIG. 1*c*), relative to the base body 10. In the lowest target position of FIG. 1*a*), the blade cartridge 40 is retracted and, in this case, is protected in a fall by the trimmer 11 of the base body 10 with respect to the covered directions of impact.

In the middle and the top target positions of FIGS. 1*b*) and *c*), the separate element with the blade cartridge 40 sticks out from the base body 10, more or less exposed. This is necessary to enable the blade cartridge to be used 40 for a wet shave. To protect the separate element with the blade cartridge 40 from damage from impact in these target positions as well, a coupling is designed between the separate element and the main device element. In the illustrated exemplary embodiment of a hair removal device 100, the coupling is designed between the intermediate element 30 and the slider 20.

Important for the intended protection of the separate element with the blade cartridge 40 is a coupling designed to have the appropriate strength so that it opens when a minimum force or minimum energies amounting to less than the forces or energies that would cause damage to the separate element or to the blade cartridge 40 (excluded from these protective effects are fall directions in which the blunt fall energy is applied to the main device element). Thus, if the hair removal device 100 falls onto the separate element, the separate element with the blade cartridge 40 separates itself from the main device element 100, which is composed of the slider 20 and the base body 10, so that the kinetic energy of the base body 10 which carries the main weight of the hair removal device 100 cannot damage the blade cartridge 40. In this connection, the release force for the coupling must be demensioned in such a way that the loads for the separate element stay in a range that does not cause damage to the blade cartridge 40 and, on the other hand, that the separate element does not inadvertently come loose from the slider 20 in the course of a normal shave.

In this connection, in FIG. 1*c*), different directions are indicated by arrows, from which an impact would lead to the opening of the coupling. In the case of an impact coming from the front, illustrated by the dotted arrow, the drop energy can be additionally absorbed by means of the slider 20 giving way or retracting.

In the case that the hair removal device 100 is dropped and the separate element is detached from the intermediate element 30 and blade cartridge 40 to protect it from damage, the user can then easily press the separate element onto the slider 20 again, like a push button.

In the following, with the aid of FIGS. 2 through 7, a specific embodiment of the coupling between the main device element (in this case, the slider 20 as a component of the main device element) and the separate element (in this case, the intermediate element 30 as a component of the main device element) is described, which is a ring snap-on connection.

Figure 2:
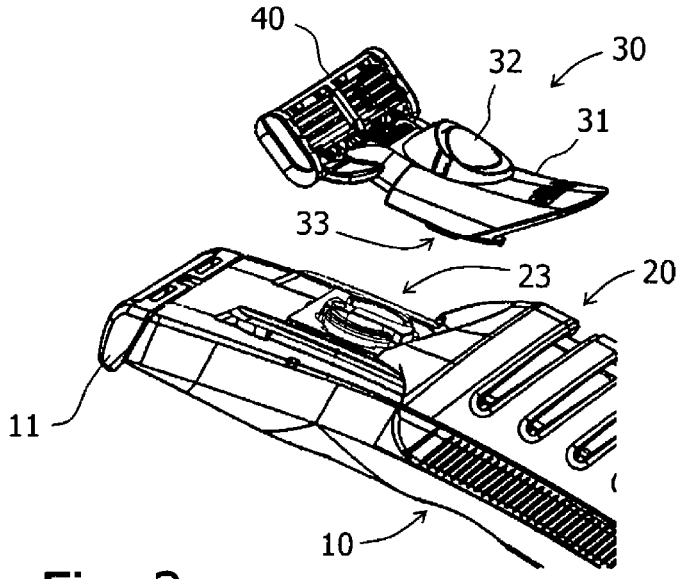
FIG. 2 shows an enlarged perspective view of the coupling area between the main device element and the separate element (with attached blade cartridge) with the coupling in the decoupled state.
Figure 3:
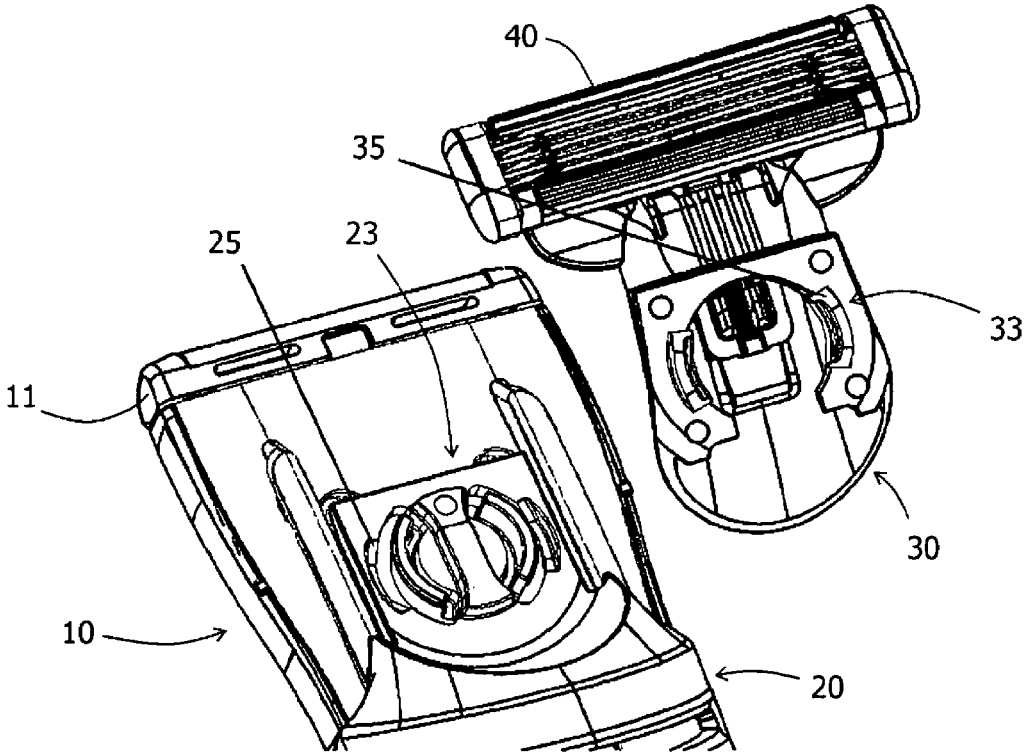
FIG. 3 shows another perspective view as in FIG. 2, with a view of the underside of the separate element.

In this context, FIGS. 2 and 3 show the separate element, composed of intermediate element 30 with the blade cartridge 40 snapped in, in the state in which it is separated from the slider 20, that is, the coupling is open. The coupling consists of a coupling component 23 on the main device element and a coupling component 33 on the separate element. By illustrating the open coupling, the latching elements 23 on the slider 20 or the latching elements 33 on the intermediate element 30 are visible.

Figure 4:
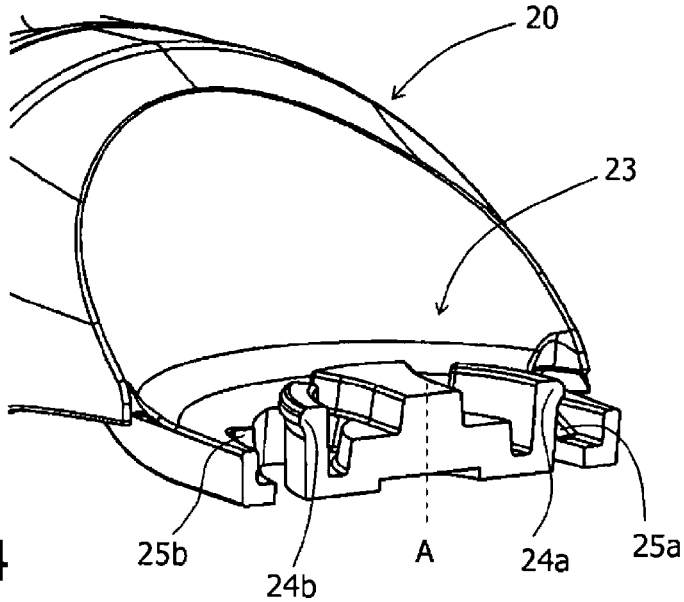
FIG. 4 shows a perspective view of a section through the latching elements of the coupling on the main device element.

In this connection, FIG. 4 shows a section through the center of the latching elements 23 on the slider 20. The latching elements comprise in particular two embossments 24*a*, 24*b* arranged on the end of a high standing flange, extending radially outward around an axis A in the shape of an arc.

Figure 5:
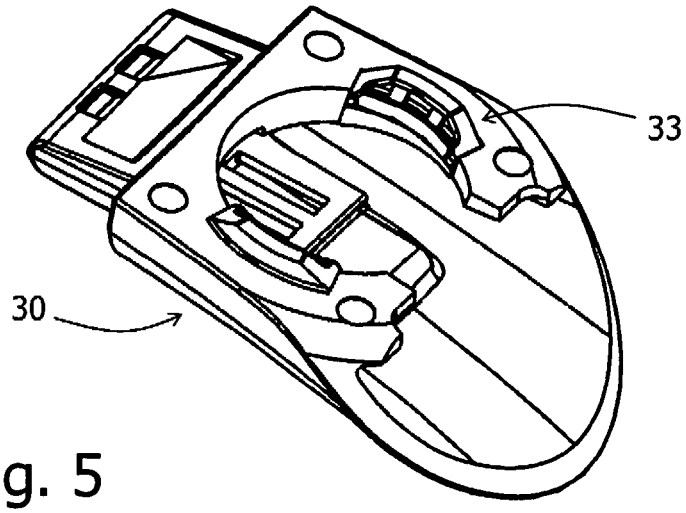
FIG. 5 shows a perspective view of the underside of the separate element.
Figure 6:
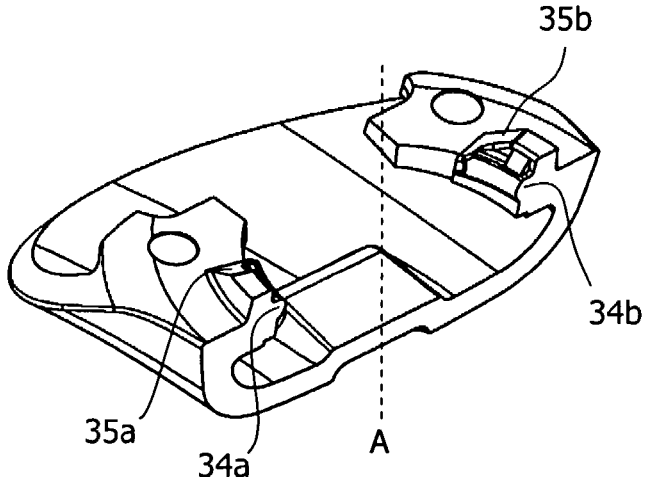
FIG. 6 shows a perspective view of a section through the latching elements of the coupling of the separate element.

FIG. 5 shows a perspective view of the latching elements 33 on the intermediate element 30 (from which the blade cartridge has been separated), and FIG. 6 shows a central section through these latching elements 33. It is apparent that the latching elements 33 comprise two embossments 34*a* and 34*b* extending in an arc around an axis A, facing radially inwardly.

Figure 7:
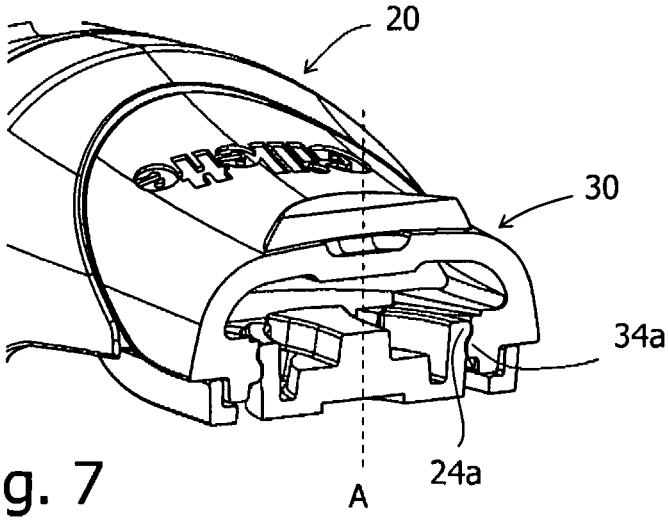
FIG. 7 shows a perspective view of a section through the latching elements of the assembled coupling of the separate element and the main device element.

Finally, FIG. 7 shows a section through the center of the connected coupling between the slider 20 and intermediate element 30. It is evident from this that the outwardly facing embossments 24*a*, 24*b* on the latching elements of the slider and the embossments 34*a*, 34*b* of the latching elements on the intermediate element 30 facing radially inward engage behind in a positive fit, in order to provide a defined position for the intermediate element on the slider 20. By means of the inward radial spring of the embossments 24*a*, 24*b* on the slider or the outward radial spring of the embossments 34*a*, 34*b* on the intermediate element 30, said embossments slide past each other to create the coupling connection or to release it, according to the principle of a latch-on or snap-on mechanism. An appropriate design of the necessary spring forces (adjustable by embossment thickness, by material pairing, by the strength of the collar on which embossments are formed, etc.) can in this way adjust the strength of the coupling to a desired range such that the coupling is closed during normal operation (a typical static force with which a blade cartridge is pressed against the skin is less than 10 N, more likely about 1 to 4 N, in particular about 2 N), but opens when dropped from normal height.

The path of the coupling embossments 24*a*, 24*b*, 34*a*, 34*b* in a circle around an axis A has the positive effect that, because of its shape, in principle, the coupling allows a relative rotation between the slider 20 and the intermediate element 30 about said axis A. A torque around axis A occurs in the case of an impact from the side on the blade cartridge or on the intermediate element 30, however, sliding surfaces on the slider 20 and/or intermediate element 30 come into action. Sliding surfaces 25*a* and 25*b* on slider 20 inclined to axis A can be seen in FIG. 4. Corresponding sliding surfaces 35*a* and 35*b* on the intermediate element 30 inclined to axis A can be seen in FIG. 6.

In the connected state of the coupling (FIG. 7), the sliding surfaces 24*a* and 34*a* and 24*b* and 34*b* lie on top of each other. If a rotational motion around the axis A then occurs, the sliding surface pairs create a screw action, in which the intermediate element 30 axially pushes away from the slider 20 (with respect to axis A) and the coupling of the embossments is thus opened.

As a result, a coupling between the base body 10 and the blade cartridge 40 (by means of the slider 20 and the intermediate element 30) is achieved in this way, which reliably releases when the hair removal device is impacted from different drop directions. The separation will cause the blade cartridge to be undamaged by the impact.

The above invention described by way of the example of a combined electrical and wet shaver can be applied by analogy to other hair removal devices, especially to heavy devices such as purely mechanical wet shavers with steel handles or wood applications or wet shavers with rechargeable battery or battery operation.

In other words, a hair removal device 100 is described, comprising a main device element 10, 20 and a separate element 30, 40 attachable to it by means of a coupling 23, 33, wherein there is at least one exposed region on the surface of the separate element 30, 40 within which a blunt force can act (i.e., without an irreversible change in the separate element, which would cause the separate element to no longer be useable as intended and, in particular, its use could lead to injury) without damaging the separate element, leading to a release of the coupling, wherein the direction of this force tends to be arbitrary, but may arise, in particular, from a given solid angle of at least approximately 0.84 sr (wherein a solid angle of 0.84 sr corresponds to a cone angle of approximately 60°). In particular, the coupling is released when the direction of the force arises from a solid angle of 3.14 sr, or an even greater solid angle. In particular, the separate element in an exposed position will be uncoupled from the main device element in every possible case in which a force greater than a minimum force can act through the separate element on the coupling. With the exception of the operative directions which would lead to a disconnection, the operational directions can be those which operate in the direction of the sliding motion of the slider (or a lesser solid angle cone around this operational direction). Then, for example, the slider can be designed in such a way that when a force acts on it, it goes from an exposed position to a covered position and the separate element is thus protected from damage.

Figure 8:
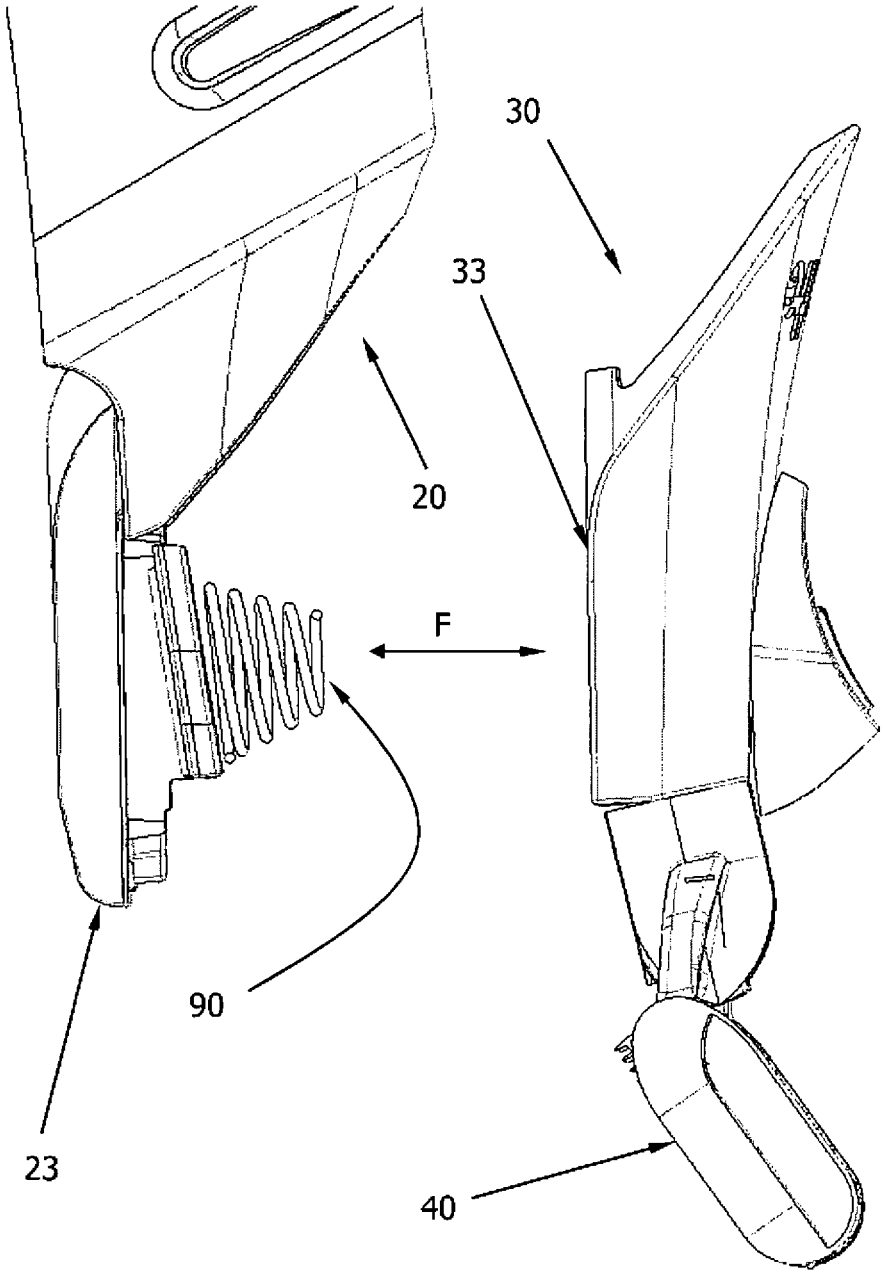
FIG. 8 shows a side view of a front area of the main device element and the separate element in an uncoupled state.

FIG. 8 shows a further embodiment of a hair removal device. FIG. 8 shows a side view of the front region of the slider 20 of the main device element and the separate element 30, 40 in the uncoupled state. In the illustrated embodiment, a spring element 90 is arranged in the coupling component 23. In the coupled state, the spring element 90 is loaded, so that a spring force acts between the main device element 10, 20 and the separate element 30, 40. The spring force and the direction of the spring force are selected such that the coupling 23, 33 is not released by the spring force. If the separate element 30, 40 is now disengaged by an external force, the spring element 90 is then discharged and releases its potential energy very quickly. By means of a very rapid expansion of the spring element 90, the lightweight separate element 30, 40 and the heavier main device element 10, 20 are pushed away from each other in the direction of double arrow F. This causes the separate element 30, 40 to essentially not be placed between the heavy main device element 10, 20 and a wall or floor, which, despite the coupling mechanism 23, 33 being released, could result in damage to the separate element 30, 40, and, in particular, to a blade cartridge 40.

In the embodiment according to FIG. 8, the spring element 90 is designed as a coiled torsion spring, which is fixed in the main device element 10, 20. This is only an exemplary embodiment. The spring element 90 can also be realized by any other spring (for example, a spiral spring or leaf spring) or an elastomeric spring (such as a rubber element). Furthermore, the spring element 90 can also be fixed to the separate element 30, 40 or it can be positioned without fixing between the main device element 10, 20 and separate element 30, 40. There can also be several spring elements 90 positioned between the main device element 10, 20 and the separate element 30, 40, wherein, for example, one spring element is fixed on the main device element 10, 20 and one spring element is fixed to the separate element 30, 40. Instead of causing the spring force to operate essentially perpendicular to the coupling plane, the spring element 90 may be arranged so that the spring force acts in a different direction.

What is claimed is:

1. A hair removal device (100) comprising a) a main device element (10, 20) which comprises the major portion of the total weight of the hair removal device (100), and b) a separate element (30, 40) which is detachably connected with the main device element (10, 20) by means of a coupling comprising a spring element (90) which is loaded to provide a spring force such that the coupling is not released by the spring force, latching elements (23, 33) characterized in that the latching elements (23, 33) at least partially grip each other along a circle around an axis (A) of rotation, said latching elements (23, 33) having sliding surfaces (25*a*, 25*b*, 35*a*, 35*b*) inclined to the axis of rotation (A) which press the latching elements axially apart when the latching elements rotate around the axis of rotation such that when a drop energy force acting on the separate element (30, 40) exceeds about 2.2 Joules, the separate element (30, 40) uncouples from the main device, element (10, 20), wherein the uncoupling occurs upon a relative rotation between the main device element (10, 20) and the separate element (30, 40) and wherein upon uncoupling the separate element (30, 40) and main device (10, 20) are pushed away from each other by expansion of said spring element (90) and the separate element (30, 40) comprises a replaceable blade cartridge.

2. The hair removal device (100) according to any of claim 1 characterized in that the main device element (10, 20)

contains an electric motor and/or a rechargeable battery and/or a battery and/or a shaving foil shaver and/or a trimmer for long hair (11).

3. The hair removal device (100) according to claim 1 characterized in that the coupling is a snap-on connection between the latching elements (23, 33) on the main device element (10, 20) and on the separate element (30, 40).

4. The hair removal device (100) according to claim 1, characterized in that the latching elements (23, 33) comprise embossments (24*a*, 24*b*, 34*a*, 34*b*) which can reciprocally engage behind one another.

* * * * *